US008100120B2

(12) United States Patent
Maeda

(10) Patent No.: US 8,100,120 B2
(45) Date of Patent: Jan. 24, 2012

(54) ELECTRIC AIR GUN

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 56 days.

(21) Appl. No.: 12/801,417

(22) Filed: Jun. 8, 2010

(65) Prior Publication Data

US 2010/0326414 A1 Dec. 30, 2010

(30) Foreign Application Priority Data

Jun. 25, 2009 (JP) ..... 2009-151576

(51) Int. Cl.
*F41B 11/00* (2006.01)

(52) U.S. Cl. ..... 124/77; 124/74

(58) Field of Classification Search ..... 124/69, 124/71, 72, 74, 77
See application file for complete search history.

(56) References Cited

U.S. PATENT DOCUMENTS

| | | | | |
|---|---|---|---|---|
| 3,000,371 | A | 9/1961 | Hyde | |
| 3,077,875 | A | 2/1963 | Kline et al. | |
| 3,951,038 | A * | 4/1976 | Van Langenhoven | 89/7 |
| 5,261,384 | A * | 11/1993 | Hu | 124/66 |
| 5,531,210 | A * | 7/1996 | Meiser et al. | 124/66 |
| 5,947,100 | A | 9/1999 | Anderson | |
| 6,415,781 | B1 | 7/2002 | Perrone | |
| 6,418,919 | B1 | 7/2002 | Perrone | |
| 6,564,788 | B1 * | 5/2003 | Hu | 124/66 |
| 6,857,422 | B2 * | 2/2005 | Pedicini et al. | 124/63 |
| 7,100,592 | B1 | 9/2006 | Yang | |
| 7,712,462 | B2 * | 5/2010 | Pedicini et al. | 124/65 |
| 7,730,881 | B1 * | 6/2010 | Pedicini et al. | 124/65 |
| 7,841,329 | B2 * | 11/2010 | Yang | 124/66 |
| 7,878,184 | B2 * | 2/2011 | Klarborg | 124/65 |
| 7,946,283 | B2 * | 5/2011 | Lee et al. | 124/67 |
| 7,975,682 | B2 * | 7/2011 | Yang | 124/67 |
| 2003/0098019 | A1 * | 5/2003 | Hu | 124/66 |

FOREIGN PATENT DOCUMENTS

| | | |
|---|---|---|
| DE | 10 2006 001 214 A1 | 1/2007 |
| EP | 0 844 456 A2 | 5/1998 |
| JP | 03-221793 A | 9/1991 |

OTHER PUBLICATIONS

Extended European Search Report, App. No. 10005242.2-1260, Jul. 29, 2010 (6 pages).

* cited by examiner

*Primary Examiner* — Troy Chambers
(74) *Attorney, Agent, or Firm* — Rader, Fishman & Grauer PLLC

(57) ABSTRACT

A bullet feed portion reciprocates and is positioned in a firing position where a bullet housing chamber is opposed to a bullet feed port, and in a non-firing position where the bullet feed port is closed. A gas flow path guides compressed gas to the bullet feed port in an inner barrel. A valve is biased to close the gas flow path. A firing action mechanism has a movable body that can be freely reciprocated along the inner barrel. The firing action mechanism moves the bullet feed portion to a firing position and moves the valve to a non-biasing direction. A power transmission unit transforms motor force into the locomotion of a movable body. When trigger is pulled, the motor moves the movable body toward the bullet feed port to feed a bullet into the bullet feed portion, and actuate the firing action mechanism.

8 Claims, 9 Drawing Sheets

ELECTRIC AIR GUN

CROSS REFERENCE TO RELATED APPLICATION

The present application is based on and claims the benefit of priority of Japanese Patent Application No. 2009-151576 filed on Jun. 25, 2009, the entire contents of which is incorporated herein by reference.

TECHNICAL FIELD

The present invention relates to an electric air gun so configured as to fire off bullets by opening the valve of a compressed gas vessel using a motor.

BACKGROUND

There have been conventionally air guns equipped with an air chamber that stores compressed gas from a compressed gas vessel and has a valve. In such an air gun, a bullet is fired off by hitting the valve with a hammer or a striker to release compressed gas.

There has also been the electric air gun (automatic electric air gun) disclosed in Japanese Unexamined Patent Publication No. Hei 3 (1991)-221793. This electric air gun is provided in its cylinder with a piston. In this electric air gun, the following takes place when its trigger is pulled: the cylinder is moved to compress the gaseous body in the cylinder and bullets are fired off by the pressure of this compressed gaseous body.

The electric air gun disclosed in Japanese Unexamined Patent Publication No. Hei 3 (1991)-221793 is equipped with a motor as a power source for moving the piston backward. The rotary power from the motor is transmitted to a sector gear through a large number of gears. The piston forms a rack. The sector gear linearly moves the piston backward to compress a piston spring. When the engagement between the sector gear and the rack is subsequently removed, the piston is moved forward by the biasing force of the spring to compress a gaseous body. A BB bullet is fired off by the pressure of the compressed gaseous body.

An air gun using a push-type solenoid as moving power for a striker for hitting the valve of a compressed gas vessel is also publicly known. In this air gun, the valve is opened by the movement of the moving core of the solenoid and the compressed gas in an air chamber is jetted out to fire off a BB bullet.

U.S. Pat. No. 5,531,210 discloses a toy gun using a rack and a pinion as a manual air gun. When a handle is manually pulled (cocking) in this air gun, the rack and the pinion are moved to compress a spring. When a trigger is pulled, the spring is decompressed. As a result, a piston advances to compress the air in the air gun and jets it out to fire off a cylindrical bullet.

U.S. Pat. No. 6,418,919 discloses a technique for using a motor to shake a bullet feed hopper and thereby letting a large number of bullets in the hopper into the gun body. U.S. Pat. No. 5,947,100 and U.S. Pat. No. 6,415,781 disclose techniques for stirring the contents in a hopper.

However, electric air guns using a motor to fire off bullets require a large number of gears. A large number of gears complicates the structure of a gun and increases its manufacturing cost. Especially, fully automatic electric air guns repeat complicated action in a short time to fire off a large amount of bullets and thus frequently become faulty. For this reason, fully automatic electric air guns are inferior in endurance. In a fully automatic electric air gun, a piston frequently jets out compressed gas and the firing pressure of compressed gas is low.

Consideration will be given to an air gun so configured as to use a solenoid to move a valve to jet compressed gas out of an air chamber without use of a motor. In this case, the inexpensive solenoid does not bring pressing force sufficient to open the valve. A solenoid that can bring sufficient pressing force is more expensive than motors and increases the manufacturing cost of a gun.

Further, consideration will be given to an electric air gun so configured as to transmit the rotary power of a motor through a large number of gears. In this case, switching between single firing and repetitive firing is mechanically carried out. For this reason, it is difficult to limit a number of times of firing and arbitrarily change a limited number of times of firing.

SUMMARY

Accordingly, an object of the present invention is to provide an electric air gun of a simple configuration that is low in manufacturing cost and durable.

According to the present invention, an electric air gun includes a hollow inner barrel guiding a bullet fed into a bullet feed port toward a muzzle, a bullet feed portion having a chamber for housing a bullet, installed so that the bullet feed portion can be freely reciprocated along the bullet feed port in the inner barrel, and positioned in a firing position for opposing the chamber to the bullet feed port and in a non-firing position for closing the bullet feed port by reciprocating movement, a gas flow path guiding compressed gas supplied from a freely detachable compressed gas cylinder to the bullet feed port in the inner barrel through the chamber of the bullet feed portion positioned in the firing position, a valve placed in the gas flow path and biased in a direction for closing this gas flow path, a firing action mechanism having a movable body that can be freely reciprocated along the inner barrel and moving the bullet feed portion to the firing position using as power the movement of the movable body toward the bullet feed port and moving the valve to a non-biasing direction at the same time, a power transmission unit having a motor and transforming the rotational driving force of the motor into the locomotion of the movable body and transmitting the locomotion through a rack and pinion mechanism, and a control unit energizing the motor using a freely detachable battery as an electric power source when detection is performed that a manually operated trigger has been pulled and moving the movable body toward the bullet feed port to actuate the firing action mechanism.

The electric air gun of the invention fires off bullets by the pressure of gas such as carbon dioxide gas or nitrogen gas as well as air. Hereafter, these gaseous bodies may be designated as "air."

DESCRIPTION OF THE DRAWINGS

Amore complete appreciation of the present invention and many of the attendant advantages thereof will be readily obtained as the same becomes better understood by reference to the following detailed description when considered in connection with the accompanying drawings, wherein:

FIG. 10 is a sectional view of the electric air gun, bisected at the center, in which the striker has returned to its initial state, following FIG. 9;

FIG. 11 is a sectional view of the electric air gun with the trigger returned, bisected at the center, following FIG. 10;

FIG. 12 is an explanatory drawing of an electric air gun as viewed from behind, illustrating the relation between the inner safety and striker of the electric air gun with a safety guard acting in the first embodiment;

FIG. 13 is an explanatory drawing illustrating a state in which the inner safety is shifted by the action of a safety motor and a bullet can be now fired off, following FIG. 12;

FIG. 14 is a sectional view of an electric air gun in a second embodiment in its initial state (before shooting operation), bisected at the center;

FIG. 15 is an explanatory drawing of the electric air gun as viewed from front, illustrating the relation between the inner safety and the bullet feed portion in the second embodiment;

FIG. 16 is an explanatory drawing of the electric air gun as viewed from front, illustrating the relation between the inner safety and the bullet feed portion in the second embodiment;

FIG. 17 is an explanatory drawing of the electric air gun as viewed from front, in which the inner safety is rotated by the safety motor and does not interfere with the downward movement of the bullet feed portion, following FIG. 16; and FIG. 18 is an explanatory drawing of the electric air gun as viewed from front, in which the bullet feed portion moves down and a bullet can be now fired off, following FIG. 17.

DETAILED DESCRIPTION

Figure 1:
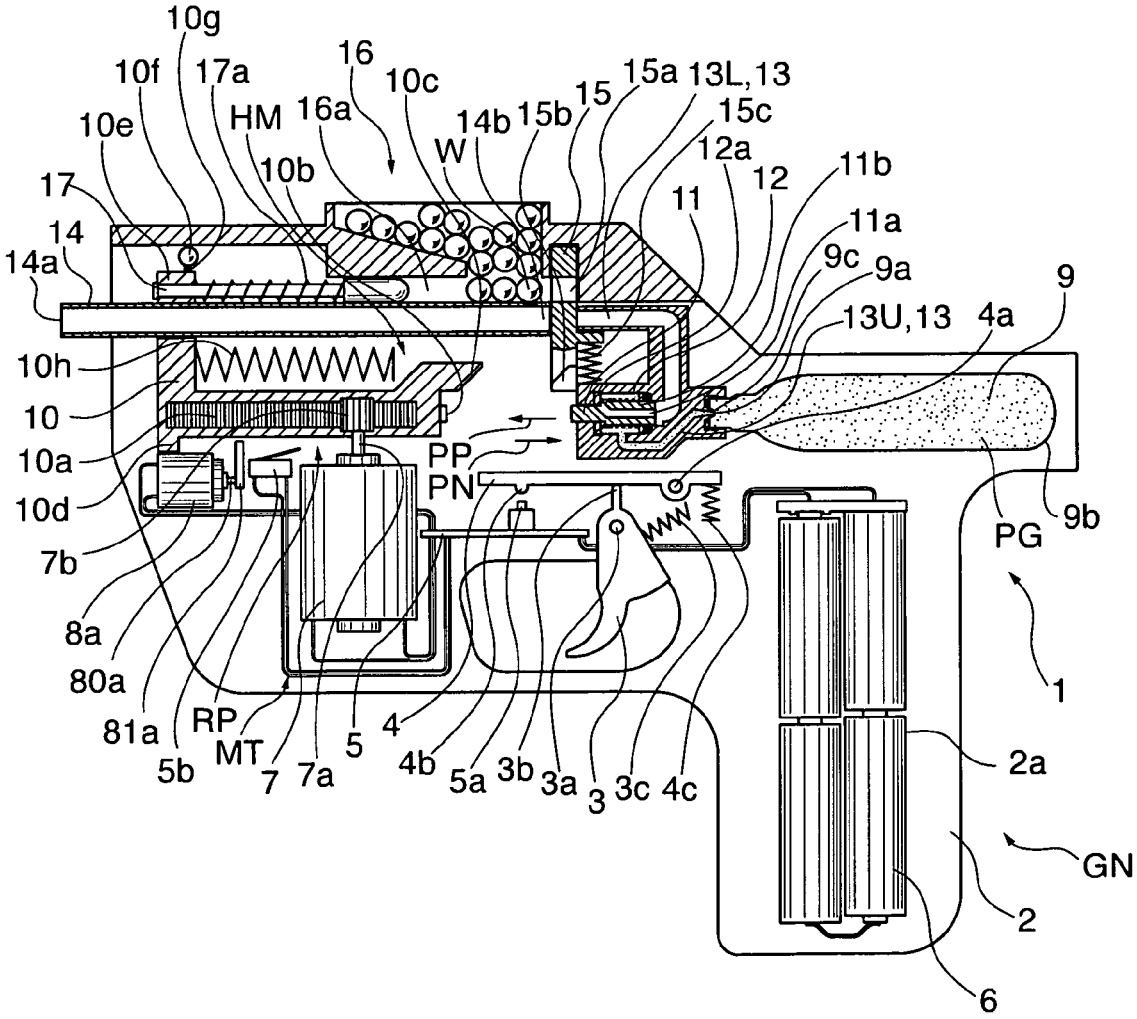
FIG. 1 is a sectional view of an electric air gun in a first embodiment in its initial state (before shooting operation), bisected at the center.
Figure 2:
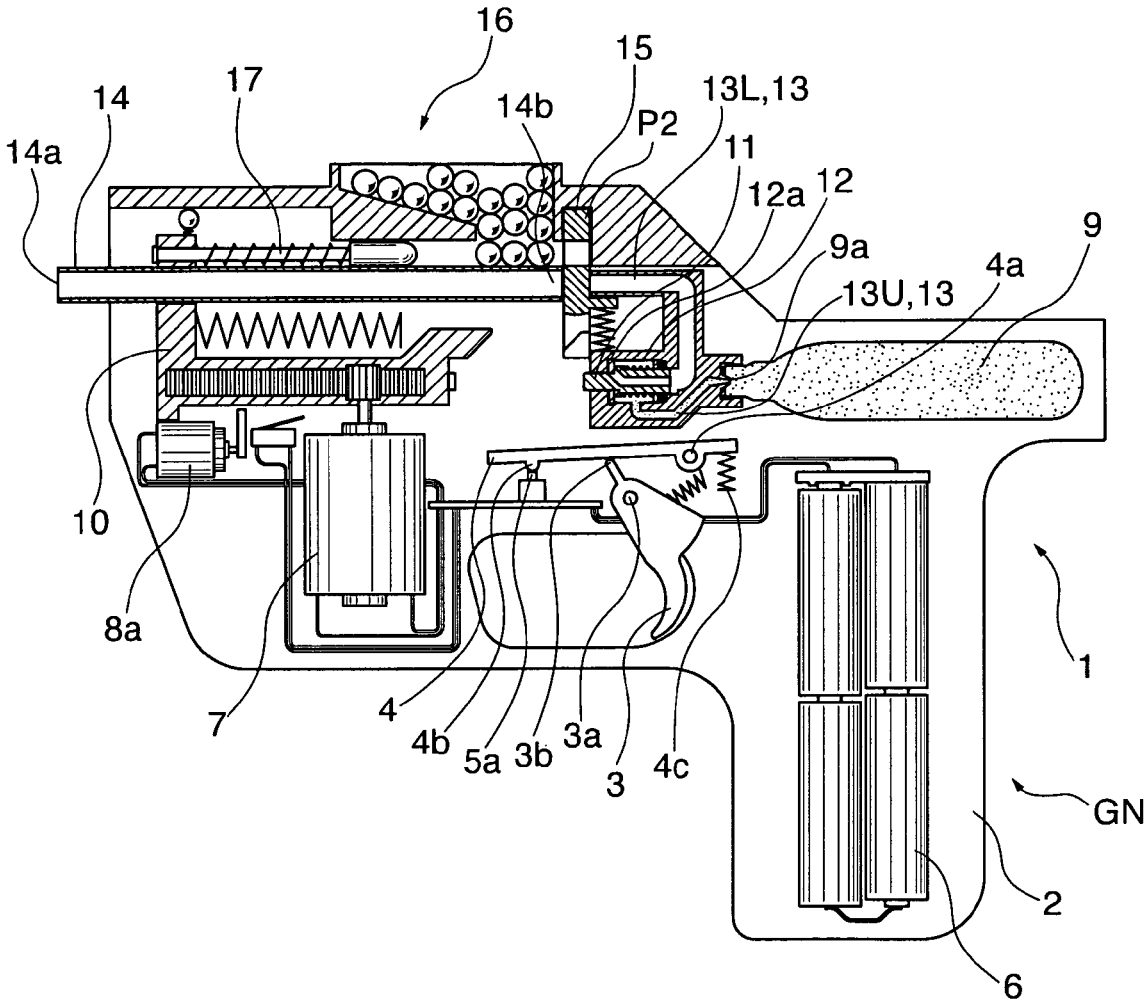
FIG. 2 is a sectional view of the electric air gun with its trigger pulled, bisected at the center, following FIG. 1.
Figure 3:
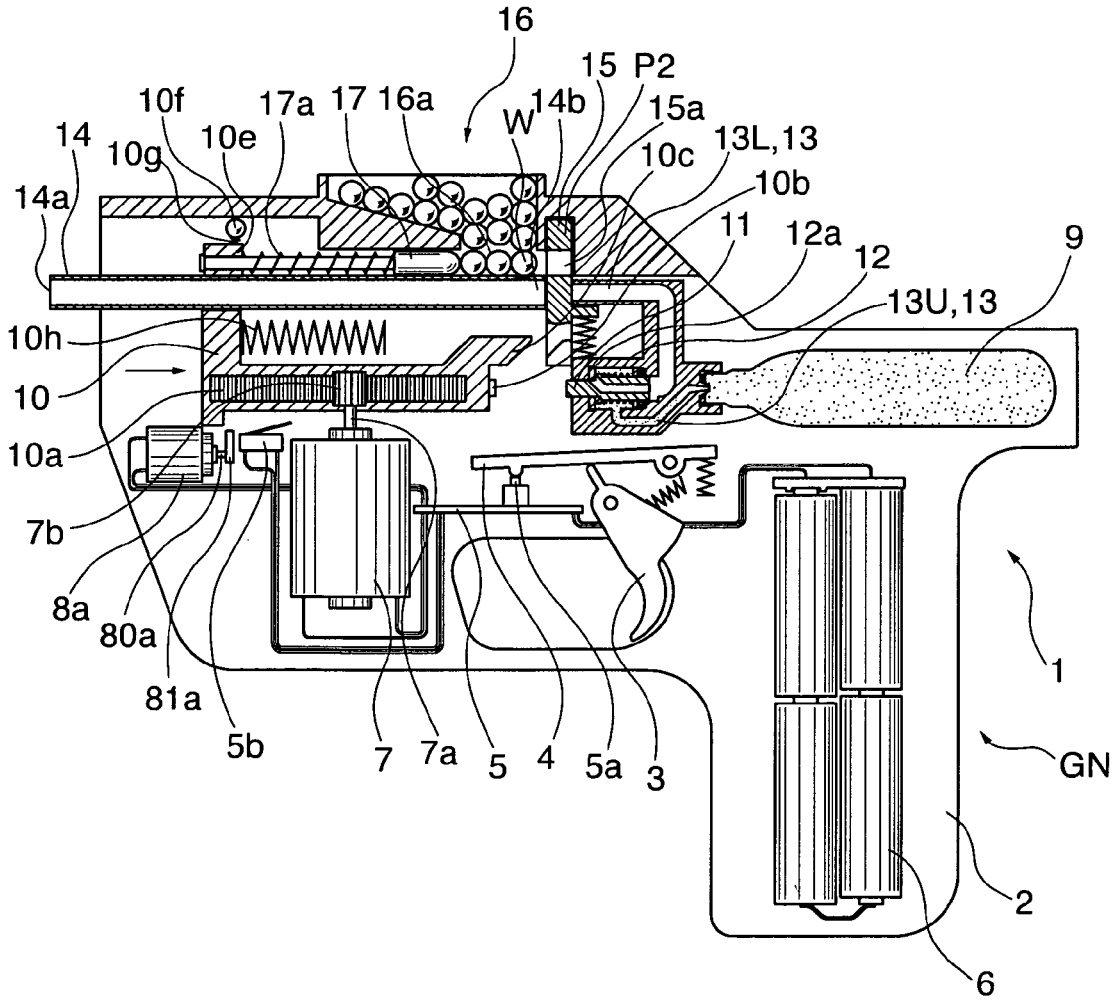
FIG. 3 is a sectional view of the electric air gun with its striker moving backward, bisected at the center, following FIG. 2.
Figure 4:
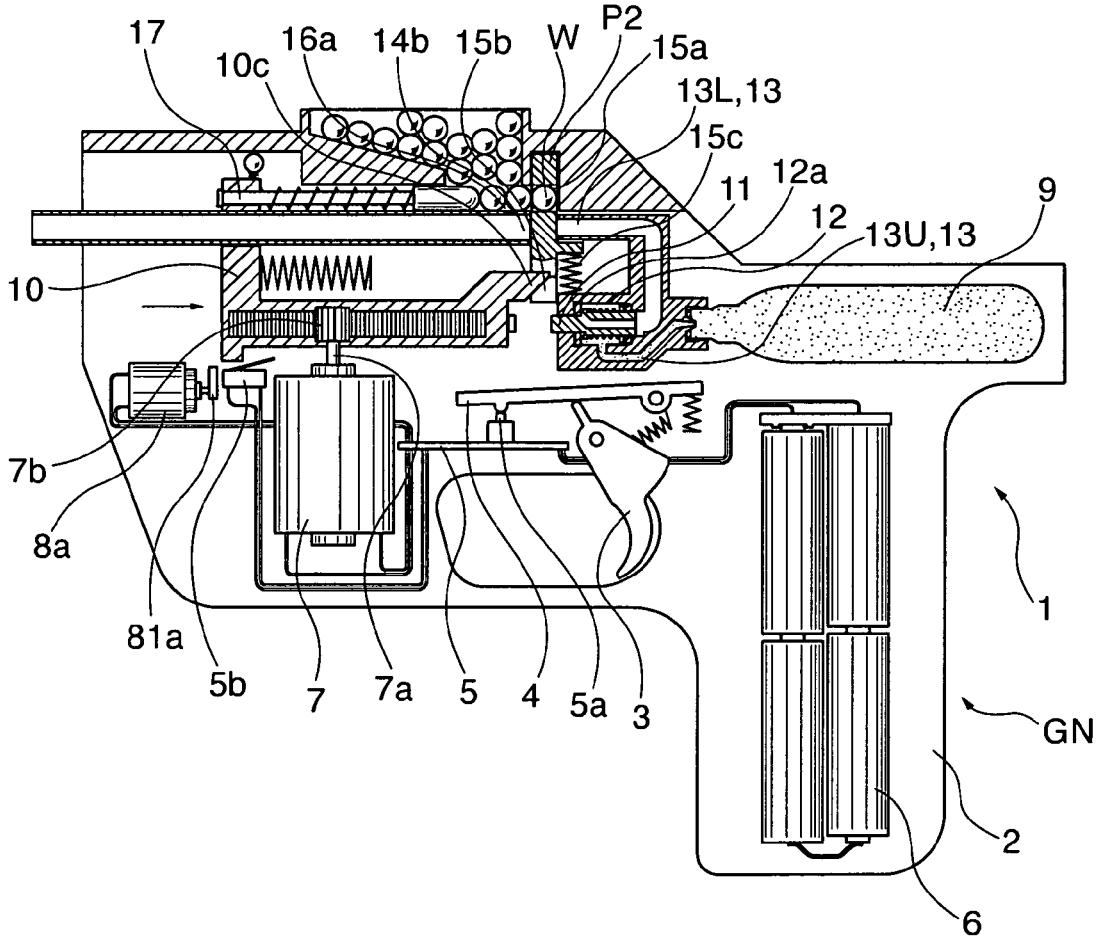
FIG. 4 is a sectional view of the electric air gun, bisected at the center, in which its rod has pushed a bullet into its chamber, following FIG. 3.

Description will be given to a first embodiment with reference to FIG. 1 to FIG. 13. The "back and forth direction" cited in this specification refers to a direction in which the muzzle 14*a* side of an electric air gun is taken as front part. The "vertical direction" cited in this specification refers to a direction in which the hopper 16 side is taken as upper part.

First, brief description will be given to an electric air gun GN in this embodiment. The electric air gun GN includes: an inner barrel 14, a bullet feed portion 15, a gas flow path 13, a valve 11, a firing action mechanism HM, a power transmission unit MT, and a control substrate 5 as a control unit. This electric air gun GN is an automatic electric air gun that uses carbon dioxide gas as compressed gas PG and fires off bullets W by the pressure of this carbon dioxide gas. Aside from compressed carbon dioxide gas, any other compressed gas such as compressed nitrogen gas and compressed air may be used for the gas.

The inner barrel 14 is hollow and cylindrical. The rear end of the inner barrel 14 is a bullet feed port 14*b*. The front end of the inner barrel 14 is a muzzle 14*a*. The inner barrel 14 guides a bullet W fed into the bullet feed port 14*b* toward the muzzle 14*a*.

The bullet feed portion 15 is a prismatic body. The bullet feed portion 15 may be a circular cylindrical body. The bullet feed portion 15 has a chamber 15*a* formed in the intermediate position in the vertical direction. The chamber 15*a* is a cavity penetrating the bullet feed portion in the back and forth direction and houses a bullet W. The bullet feed portion 15 can freely reciprocate along the bullet feed port 14*b*. The bullet feed portion 15 reciprocates and is positioned in either a firing position P1 or a non-firing position P2. The firing position P1 is a position where the chamber 15*a* is opposed to the bullet feed port 14*b*. The non-firing position P2 is a position where the bullet feed portion 15 closes the bullet feed port 14*b*.

The gas flow path 13 guides compressed gas PG to the bullet feed port 14*b* in the inner barrel 14 through the chamber 15*a* in the bullet feed portion 15 positioned in the firing position P1. The compressed gas PG is supplied from a compressed gas cylinder 9 that can be freely attached to and detached from the electric air gun GN.

The valve 11 is placed in the gas flow path 13. The valve 11 is biased in a biasing direction PP to close the gas flow path 13.

The firing action mechanism HM has a striker 10. The striker 10 is a movable body that can be freely reciprocated along the inner barrel 14. The firing action mechanism HM uses the movement of the striker 10 toward the bullet feed port 14*b* as power to move the bullet feed portion 15 to the firing position P1. Further, it moves the valve 11 to a non-biasing direction PN.

The power transmission unit MT is equipped with a main motor 7. The rotating shaft 7*a* of the main motor 7 is provided with a pinion 7*b*. The pinion 7*b*, together with a rack 10*a*, forms a rack and pinion mechanism RP. The power transmission unit MT transforms the rotational driving force of the main motor 7 into the locomotion of the striker 10 and transmits it through the rack and pinion mechanism RP.

When it is detected that the manually operated trigger 3 has been pulled, the control substrate 5 actuates the firing action mechanism HM. More specifically, the control substrate 5 energizes the main motor 7 using batteries 6 as an electric power source to move the striker 10 toward the bullet feed port 14*b*.

Detailed description will be given to each part of the electric air gun GN.

The electric air gun GN includes a body 1. A grip 2 is formed at the rear lower part of the body 1. The grip 2 has a battery housing portion 2*a* as a cavity formed therein. Batteries 6 can be freely loaded to and unloaded from the battery housing portion 2*a*. At the rear part of the body 1, a compressed gas cylinder housing portion 9*b* as a cavity is formed. The body 1 is provided in front of the grip 2 with the trigger 3. The trigger 3 can be freely rotated around a trigger shaft 3*a*. The lower part of the trigger 3 is biased forward of the trigger shaft 3*a* by a trigger spring 3*c* (initial state). The upper end of the trigger 3 is a sear support portion 3*b*.

A trigger sear 4 is a plate-like body positioned above the trigger 3. The trigger sear 4 may be a rod-like body. The trigger sear 4 can be freely rotated around a trigger sear rotating shaft 4*a*. A trigger sear spring 4*c* biases the portion of the trigger sear 4 behind the trigger sear rotating shaft 4*a* upward to move the portion of the trigger sear 4 ahead of the trigger sear rotating shaft 4*a* downward. In the initial state, the sear support portion 3*b* is abutted against the under surface of the trigger sear 4 and supports it so that the front part of the trigger sear 4 is not rotated downward. The trigger sear 4 has a projection-like activation switch pressing portion 4*b* on its under surface.

The control substrate 5 is an electric circuit that is mounted with a microcomputer (not shown) and electrically connects the batteries 6, the main motor 7 (described later), and a safety motor 8*a* (described later) with one another. The microcomputer (not shown) controls the main motor 7 and the safety motor 8*a* using the batteries 6 as an electric power source. The control substrate 5 has an activation switch 5*a* and a stop switch 5*b* connected therewith. The activation switch 5*a* is positioned under the activation switch pressing portion 4*b*. When the front part of the trigger sear 4 is rotated downward, the activation switch pressing portion 4*b* presses the activation switch 5*a*. As a result, the main motor 7 and the safety motor 8*a* are fed with electric power and driven. The stop switch 5*b* is pressed by a stop switch pressing portion 10*d*. When the stop switch 5*b* is pressed, energization of the main motor 7 is immediately stopped. Electric power supply to the safety motor 8*a* is stopped with a delay by a timer function implemented under the control of the microcomputer (not shown).

The rotating shaft 7*a* of the main motor 7 is vertically oriented. The pinion 7*b* is fixed on the upper part of the rotating shaft 7*a*.

The striker 10 is a plate-like member long in the back and forth direction of the electric air gun GN. The rack 10*a* is fixedly provided on the left side face of the striker 10 and is extended in the back and forth direction of the electric air gun GN. The rack 10*a* is engaged with the pinion 7*b*. The striker 10 is moved backward by rotational driving of the main motor 7.

In the electric air gun GN in this embodiment, the main motor 7 moves the striker 10 backward only. The striker 10 is moved forward by the forward biasing force of a striker spring 10*h* positioned between the body 1 and the front part of the striker 10.

A valve pressing portion 10*b* is protruded backward from the rear end face of the striker 10. When the striker 10 is moved backward, the valve pressing portion 10*b* presses the front end of the valve 11 to move the valve 11 to the non-biasing direction PN.

The striker 10 has a bullet feed portion actuating portion 10*c* above the valve pressing portion 10*b*. The bullet feed portion actuating portion 10*c* is extended backward beyond the valve pressing portion 10*b*. The rear end face of the bullet feed portion actuating portion 10*c* forms a downward slope extended from the front lower part to the rear upper part.

The stop switch pressing portion 10*d* is protruded downward from the front part of the striker 10. In process of the striker 10 moving forward and backward, the stop switch pressing portion 10*d* presses the stop switch 5*b* from above.

At the front part of the striker 10, a rod support portion 10*e* is protruded upward. The rod support portion 10*e* is protruded upward beyond the inner barrel 14 and slidably supports the circumferential surface of a rod 17 (described later).

A hopper striker 10*f* is installed above the rod support portion 10*e* through a hopper striker spring 10*g*. The hopper striker 10*f* is spherical. In process of the striker 10 moving forward and backward, the hopper striker 10*f* collides with the outer wall face of the hopper 16.

The valve 11 is housed in an air chamber 12 formed at some midpoint in the gas flow path 13 so that it can be freely slid in the back and forth direction. In the following description, the portion of the gas flow path 13 extended from the air chamber 12 toward a gas supply port 9*a* may be designated as upstream gas flow path 13U. The portion of the gas flow path 13 extended from the air chamber 12 toward the inner barrel 14 may be designated as downstream gas flow path 13L. The front part of the valve 11 is a small diameter portion. The rear part of the valve 11 is a large diameter portion. The valve 11 forms a hollow gas passage 11*a* through which compressed gas PG passes so that it penetrates the valve in the back and forth direction. One opening (front-side opening) of the gas passage 11*a* is positioned between the large diameter portion and the small diameter portion. The other opening (rear-side opening) of the gas passage 11*a* is positioned in the rear end face of the large diameter portion and connects to the upstream end of the downstream gas flow path 13L.

A valve spring 11*b* is placed in the air chamber 12. The valve spring lib biases the valve 11 forward relative to the air chamber 12. The valve 11 is positioned coaxially with the movement axis of the valve pressing portion 10*b* behind the striker 10. Packing 12*a* is provided in front of the inner wall face of the air chamber 12.

In the initial state, the valve spring lib pushes the valve 11 forward to press it against the packing 12*a* and thereby closes the front-side opening of the gas passage 11*a*. When the striker 10 moves backward, the valve pressing portion 10*b* presses the front end of the valve 11 to move the valve 11 backward and causes it to break away from the packing 12*a*. As a result, the airtightness in the air chamber 12 is removed.

The air chamber 12 communicates with the gas supply port 9*a* in the compressed gas cylinder 9 through the upstream gas flow path 13U. The compressed gas cylinder 9 is detachably housed in the compressed gas cylinder housing portion 9*b*. At this time, the gas jet port 9*c* of the compressed gas cylinder 9 is attached to the gas supply port 9*a*. The compressed gas cylinder 9 feeds compressed gas PG into the air chamber 12 through the air chamber 12 and the upstream gas flow path 13U.

The upstream end of the downstream gas flow path 13L communicates with the rear-side opening open in the rear end face of the valve 11. The downstream end of the downstream gas flow path 13L communicates with the bullet feed port 14*b* in the inner barrel 14 through the chamber 15*a* in the bullet feed portion 15.

The bullet feed portion 15 can be freely moved in the vertical direction between the bullet feed port 14*b* in the inner barrel 14 and the downstream end of the downstream gas flow path 13L. A striker engaging portion 15*b* is formed at the lower part of the bullet feed portion 15. The striker engaging portion 15*b* is a projection that is projected to both sides of the electric air gun GN and has a slope low at front and high at rear. A bullet feed portion spring 15*c* is positioned between the bullet feed portion 15 and the body 1. The bullet feed portion spring 15*c* biases the bullet feed portion 15 upward.

In the initial state, the bullet feed portion spring 15*c* positions the bullet feed portion 15 in the upper position. The chamber 15*a* is positioned in a position corresponding to the bullet feed passage 16*a* (described later) in the hopper 16. In this state, the chamber 15*a* is supplied with a bullet W. Such a position of the bullet feed portion 15 that the chamber 15*a* is supplied with a bullet W is an example of the non-firing position P2.

When the striker 10 moves backward, the slope of the bullet feed portion actuating portion 10*c* is abutted against the striker engaging portion 15*b*. The striker engaging portion

15*b* is pressed against the biasing force of the bullet feed portion spring 15*c*. As a result, the bullet feed portion 15 moves downward and the chamber 15*a* is positioned in a position (firing position P1) between the bullet feed port 14*b* of the inner barrel 14 and the downstream end of the downstream gas flow path 13L.

The hopper 16 is in the shape of a receptacle with its top open and holds a large number of bullets W. The downstream end of the hopper 16 communicates with the bullet feed passage 16*a*. This bullet feed passage 16*a* is formed above the inner barrel 14 in the body 1 and is provided in parallel with the inner barrel 14 in the back and forth direction of the electric air gun GN.

The rod 17 is a stick-like body that is supported by the rod support portion 10*e* and slides forward and backward in the bullet feed passage 16*a*. The rod 17 presses backward a bullet W that dropped from the hopper 16 and is in the bullet feed passage 16*a* and pushes it into the chamber 15*a*. The rod 17 is provided around its circumferential surface with a rod spring 17*a*. One end of the rod spring 17*a* is in contact with the rod 17. The other end of the rod spring 17*a* is in contact with the rod support portion 10*e*. The rod spring 17*a* biases the rod 17 backward of the rod support portion 10*e*.

Description will be given to the safety motor 8*a*, an inner safety 81*a*, and a safety spring 82*a* with reference to, especially, FIG. 12 and FIG. 13. The safety motor 8*a* is installed under and behind the stop switch pressing portion 10*d* of the striker 10. The safety rotating shaft 80*a* of the safety motor 8*a* faces backward of the body 1. The inner safety 81*a* is fixedly provided on the safety rotating shaft 80*a*.

In the initial state, the inner safety 81*a* is biased by the biasing force of the safety spring 82*a* as illustrated in FIG. 12. At this time, the inner safety 81*a* is located in a position where it collides with the stop switch pressing portion 10*d* of the striker 10 moving backward.

When the activation switch 5*a* is pressed and the safety motor 8*a* is driven, the safety rotating shaft 80*a* is rotated. Then the inner safety 81*a* is rotated against the biasing force of the safety spring 82*a* as illustrated in FIG. 13 and arrives at a position where the collision with the stop switch pressing portion 10*d* is avoided.

Description will be given to a second embodiment with reference to FIG. 14 to FIG. 18. The same elements as in the first embodiment will be marked with the same reference numerals and the description thereof will be omitted. In this embodiment, the main motor 7 is rotated forward and backward and the striker 10 reciprocates forward and backward.

In this embodiment, the safety motor 8*b* is positioned substantially under the bullet feed portion 15 and under the striker 10. The safety rotating shaft 80*b* of the safety motor 8*b* faces backward of the electric air gun GN as illustrated in FIG. 14. The inner safety 81*b* is fixedly provided and placed under the path of the movement of the bullet feed portion 15. An opening 15*d* is formed in the center of the lower part of the bullet feed portion 15. (Refer to FIG. 15 to FIG. 18.)

Description will be given to the safety motor 8*b*, the inner safety 81*b*, and a safety spring 82*b* with reference to, especially, FIG. 15 to FIG. 18. In the initial state, the inner safety 81*b* is rotationally biased by the biasing force of the safety spring 82*b* as illustrated in FIG. 15 and FIG. 16. When the bullet feed portion 15 moves down, the inner safety 81*b* is abutted against the lower end face of the bullet feed portion 15 and arrests the downward movement of the bullet feed portion 15. As a result, the inner barrel 14 and the chamber 15*a* are not aligned with each other. When the striker 10 moves backward in this state, the bullet feed portion actuating portion 10*c* is brought into contact with the striker engaging portion 15*b* and the backward movement of the striker 10 is arrested. That is, the striker 10 is not caused to press the valve 11 by any other reason than pulling the trigger 3. Even though compressed gas PG is discharged into the gas flow path 13 by any other reason than pulling the trigger 3, a bullet W is not shot out by accident.

When the trigger 3 is pulled, the activation switch 5*a* is pressed and the safety rotating shaft 80*b* is rotated. Then the inner safety 81*b* is rotated against the biasing force of the safety spring 82*b* and is not abutted against the lower end of the bullet feed portion 15 and enters the opening 15*d* as illustrated in FIG. 17 and FIG. 18. This allows the bullet feed portion 15 to move down. As a result, the chamber 15*a* is stopped in the position where it is aligned with the inner barrel 14 and a bullet W is fired off.

Description will be given to one cycle of the action of the electric air gun GN in the first embodiment with reference to FIG. 1 to FIG. 11. This cycle starts with the initial state and ends when after a bullet W is fired off, the electric air gun returns to the initial state.

FIG. 1 illustrates the electric air gun GN in its initial state (before shooting operation). In the state in FIG. 1, the activation switch 5*a* is not pressed and the main motor 7 or the safety motor 8*a* is not supplied with electric power from the batteries 6. Therefore, the rotating shaft 7*a* of the main motor 7 is not rotated. The inner safety 81*a* is positioned in the position where it can collide with the stop switch pressing portion 10*d* of the striker 10, by the biasing force of the safety spring 82*a* and prevents a bullet W from being fired off by accident.

When the trigger 3 is pulled by an operator (FIG. 2), the sear support portion 3*b* is rotated forward. As a result, the trigger sear 4 is rotated around the trigger sear rotating shaft 4*a* by the biasing force of the trigger sear spring 4*c* and the activation switch pressing portion 4*b* presses the activation switch 5*a*.

When the activation switch 5*a* is pressed (FIG. 3), the main motor 7 and the safety motor 8*a* are supplied with electric power and driven. The inner safety 81*a* is rotated by the operation of the safety motor 8*a* and moves to the position where it does not collide with the stop switch pressing portion 10*d*. In addition, the rotating shaft 7*a* is rotated in a direction in which the striker 10 moves backward by the operation of the main motor 7. As a result, the pinion 7*b* engaged with the rack 10*a* is also rotated. As the result of the rotation of the pinion 7*b*, the entire striker 10 is linearly moved backward against the forward biasing force of the striker spring 10*h*. As the result of the backward movement of the striker 10, the rod 17 is also moved backward in the bullet feed passage 16*a*.

When the striker 10 further moves backward (FIG. 4), the rear end portion of the rod 17 pushes a bullet W in the bullet feed passage 16*a* backward and feeds the bullet W into the chamber 15*a*. At the same time, the bullet feed portion actuating portion 10*c* is abutted against the striker engaging portion 15*b*.

When the striker 10 further moves backward (FIG. 5), the bullet feed portion actuating portion 10*c* and the striker engaging portion 15*b* press each other and slide on each other. This causes the bullet feed portion 15 to move down against the upward biasing force of the bullet feed portion spring 15*c*. As the result of the downward movement of the bullet feed portion 15, the chamber 15*a* is stopped in the position (firing position P1) where it is aligned with the bullet feed port 14*b* in the inner barrel 14. At the time, the front wall of the bullet feed portion 15 closes the rear end of the bullet feed passage 16*a*. For this reason, the rod 17 that moves backward together with the striker 10 cannot move backward beyond a certain position because of one or more bullets W existing in the bullet feed passage 16*a*. In this case, the rod 17 is stopped in its tracks against the biasing force of the rod spring 17*a* despite the backward movement of the rod support portion 10*e*. At the same time, the stop switch pressing portion 10*d* of the striker 10 pushes the stop switch 5*b*. This causes the control substrate 5 to interrupt electric power supply to the main motor 7. As a result, the main motor 7 stops driving of the rotating shaft 7*a*. The striker 10 moves backward by inertia. When the stop switch 5*b* is pressed, meanwhile, electric power supply to the safety motor 8*a* is not interrupted. After a certain time has passed (after the state illustrated in FIG. 9), the electric power supply is interrupted by the timer function of the microcomputer and the rotation of the safety motor stops.

Figure 5:
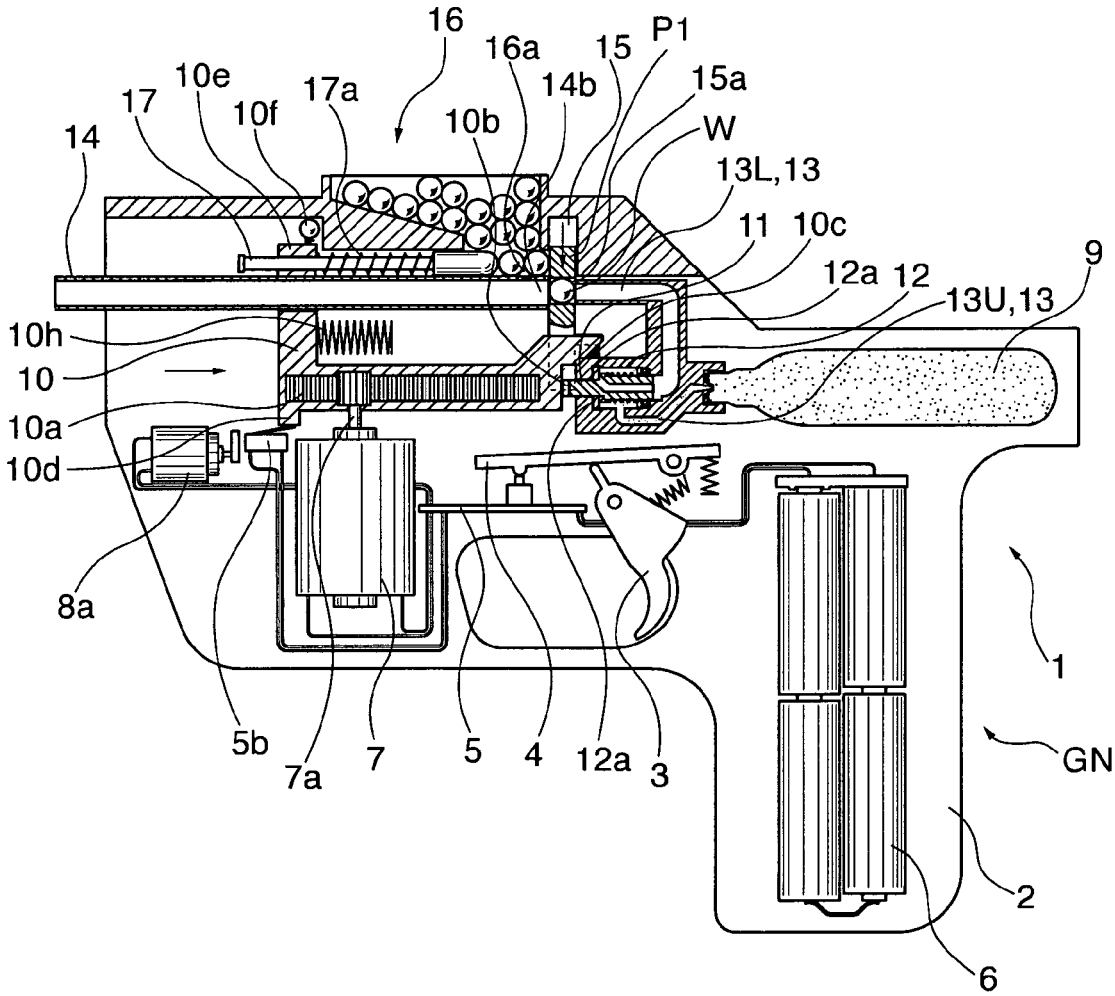
FIG. 5 is a sectional view of the electric air gun, bisected at the center, in which the striker collides with a valve to push down a bullet feed portion and the bullet in the chamber is aligned with the center of an inner barrel, following FIG. 4.
Figure 6:
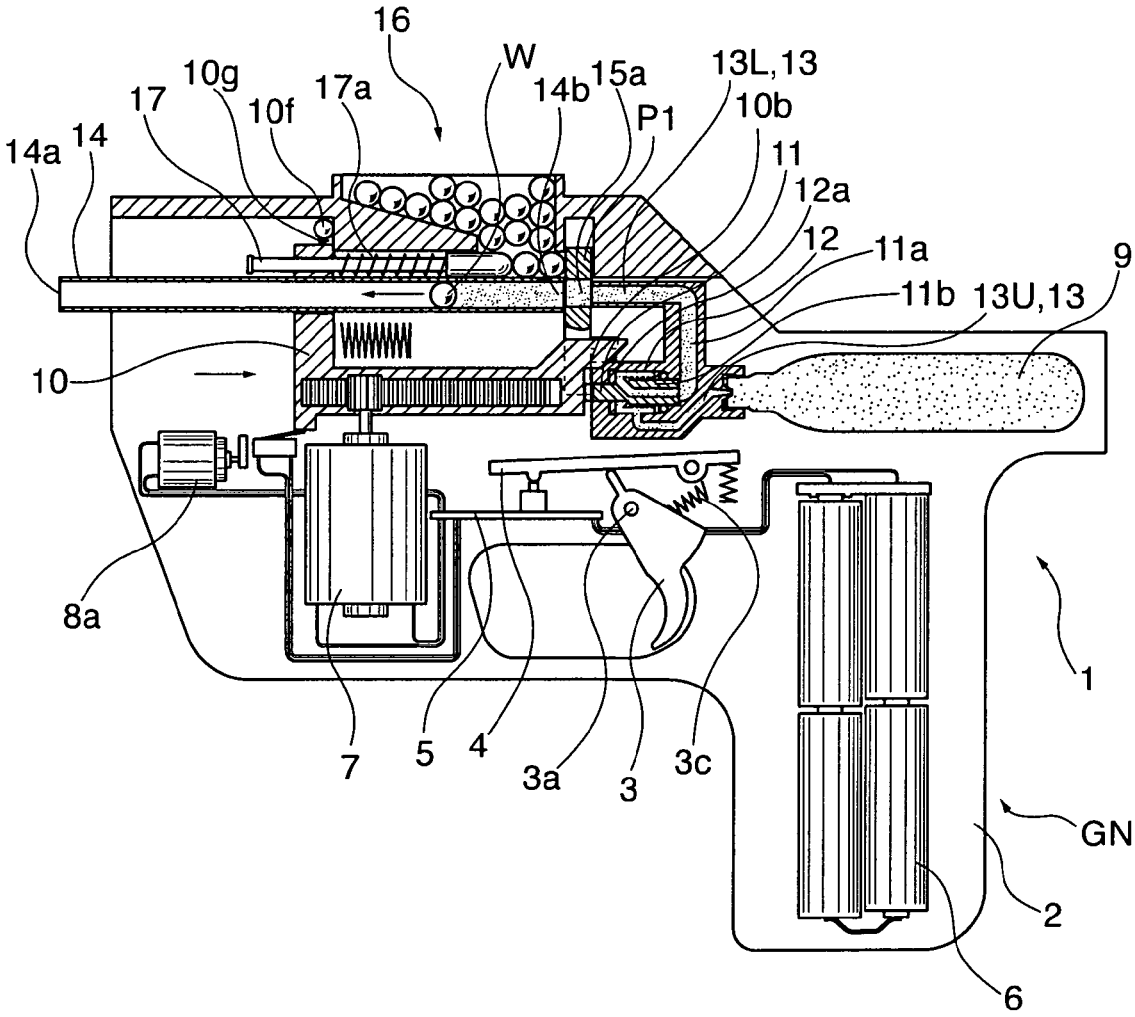
FIG. 6 is a sectional view of the electric air gun, bisected at the center, in which the valve moves to discharge the gas in an air chamber from a gas flow path to the inner barrel and the bullet is moving in the inner barrel, following FIG. 5.

FIG. 6 illustrates a state in which the striker 10 has further moved backward by inertia, following FIG. 5. The valve pressing portion 10*b* presses the front end of the valve 11 backward. The valve 11 is moved backward against the biasing force of the valve spring 11*b* in the air chamber 12. This opens the front-side opening of the gas passage 11*a* closed by the packing 12*a* in the air chamber 12 and the airtightness in the air chamber 12 is removed. As a result, compressed gas PG from the compressed gas cylinder 9 flows from the upstream gas flow path 13U to the front-side opening of the gas passage 11*a* to the gas passage 11*a* to the downstream gas flow path 13L. It thereby pushes out a bullet W positioned in the chamber 15*a* and causes it to move from the bullet feed port 14*b* in the inner barrel 14 toward the muzzle 14*a*.

As this time, the hopper striker 10*f* collides with a side face of the lower part of the hopper 16. The hopper striker 10*f* is swung by the hopper striker spring 10*g* and shakes the hopper 16. As a result, the bullets W in the hopper 16 are stirred.

Figure 7:
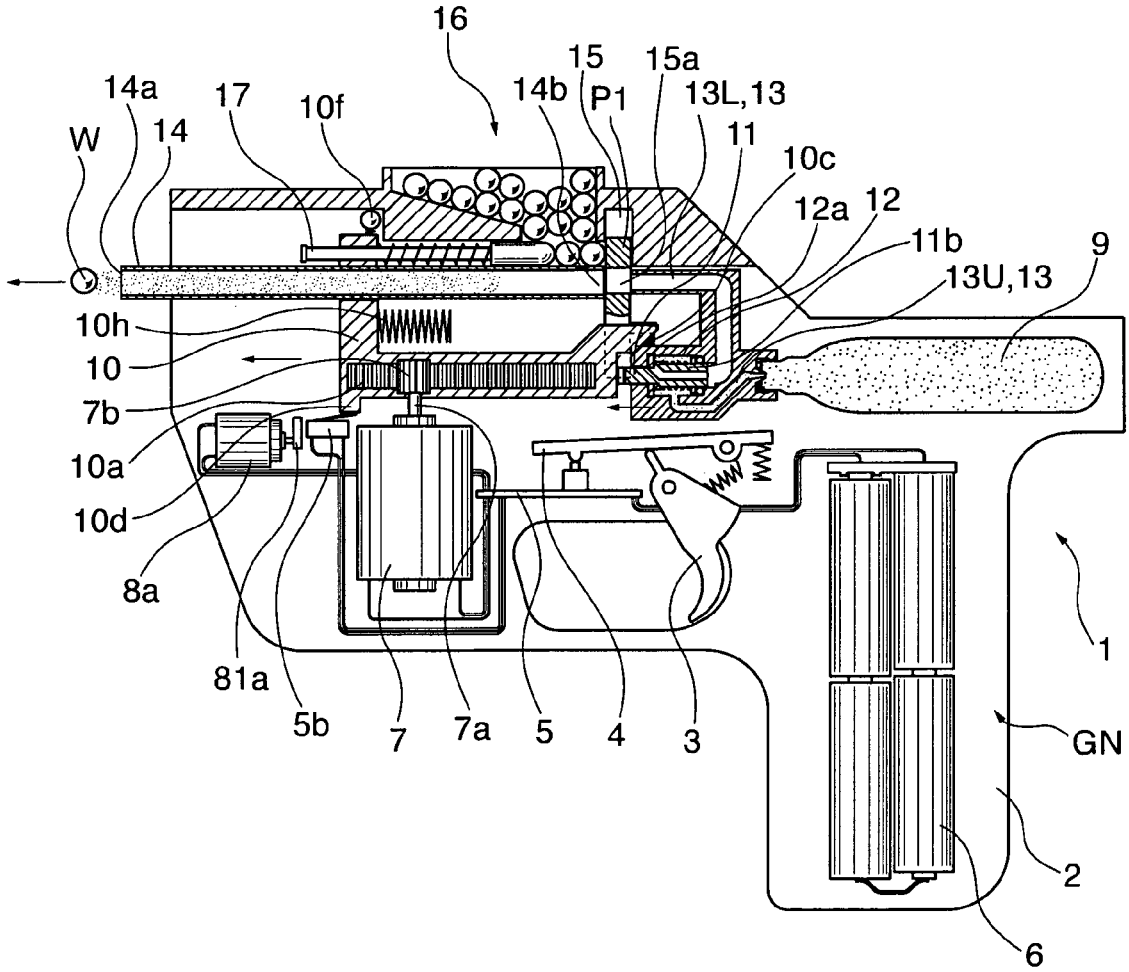
FIG. 7 is a sectional view of the electric air gun, bisected at the center, in which the bullet is fired off from a muzzle and the striker starts to advance, following FIG. 6.

FIG. 7 illustrates a state in which the bullet W is fired off from the muzzle 14*a*. The valve 11 is moved forward by the biasing force of the valve spring 11*b* and returns to its initial state. Then the front-side opening of the gas passage 11*a* is closed by the packing 12*a*. As a result, the outflow of the compressed gas PG to the downstream gas flow path 13L is stopped.

Figure 8:
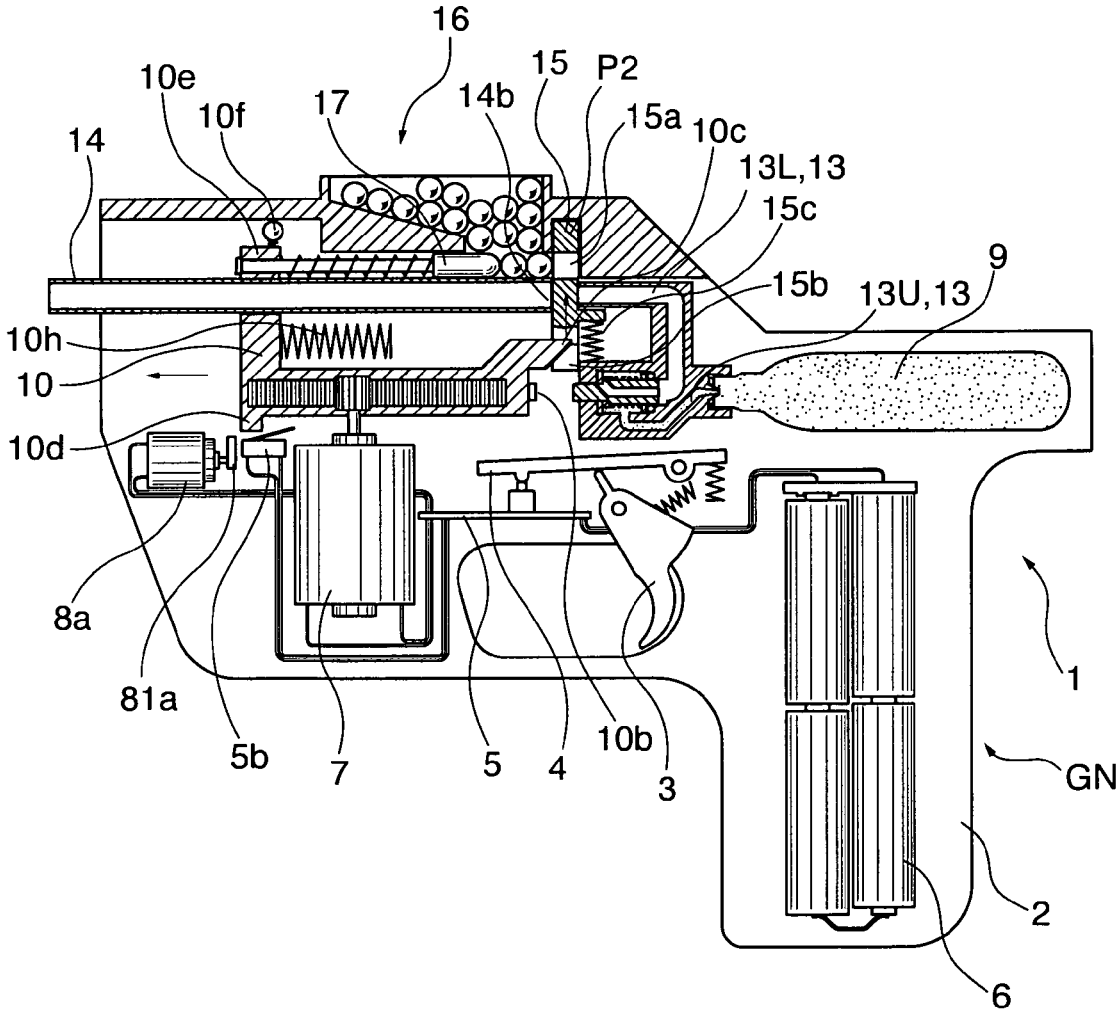
FIG. 8 is a sectional view of the electric air gun, bisected at the center, in which the striker further advances and the bullet feed portion is moved upward by a bullet feed portion spring, following FIG. 7.

Thereafter, the striker 10 starts to move forward due to the forward biasing force of the striker spring 10*h* (FIG. 8). In the second embodiment, though not shown in the drawings, the striker 10 is moved forward by rotating the main motor 7 backward. When the striker 10 moves forward, the abutment between the striker engaging portion 15*b* and the bullet feed portion actuating portion 10*c* is removed. As a result, the bullet feed portion 15 is moved upward to the position where it was in its initial state by the upward biasing force of the bullet feed portion spring 15*c*. As the result of the forward movement of the striker 10, the rod 17 is also engaged with the rod support portion 10*e*. Even though the stop switch 5*b* is pressed, the safety motor 8*a* is energized according to the timer until the state illustrated in FIG. 8 is established. The inner safety 81*a* has been rotated as illustrated in FIG. 13. Even though the striker 10 moves forward, for this reason, the stop switch pressing portion 10*d* does not collide with the inner safety 81*a*.

Figure 9:
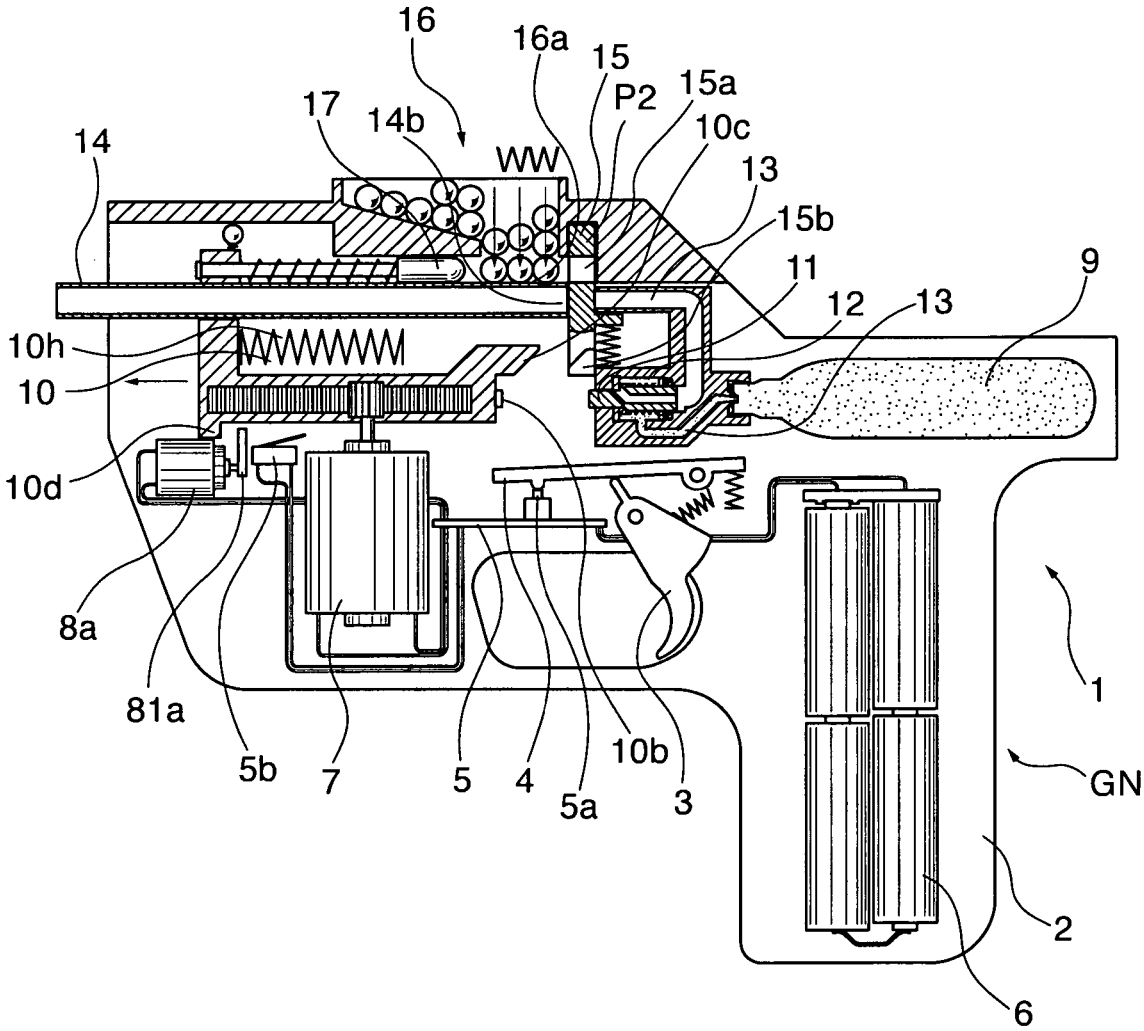
FIG. 9 is a sectional view of the electric air gun, bisected at the center, in which the striker further advances and an inner safety returns to its initial state, following FIG. 8.

When the rod 17 moves forward together with the striker 10, an air gap is produced in the bullet feed passage 16*a* positioned under the hopper 16 as illustrated in FIG. 9. As a result, multiple bullets W drop into the bullet feed passage 16*a*. As an example, three bullets W drop as illustrated in FIG. 9. When the stop switch pressing portion 10*d* of the striker 10 moves forward beyond the inner safety 81*a*, electric power supply to the safety motor 8*a* carried out according to the timer is interrupted. For this reason, the inner safety 81*a* is rotated by the biasing force of the safety spring 82*a* and returns to the initial position where it interferes with the backward movement of the stop switch pressing portion 10*d* (FIG. 12). In this initial position, the striker 10 does not press the valve 11 even in the following case: a case where the striker 10 is moved backward against the biasing force of the striker spring 10*h* because impact is applied to the electric air gun due to, for example, dropping of the electric air gun or for any other like reason. This is because the inner safety 81*a* is positioned at some midpoint in the path by which the striker 10 moves backward. Thus a bullet W is not fired off from the electric air gun unless the trigger 3 is pulled and the activation switch 5*a* is pressed.

Subsequently, the striker 10 is returned to the initial position by the forward biasing force of the striker spring 10*h* (FIG. 10).

When the operator removes his/her finger from the trigger 3, the trigger 3 is returned to the initial position by the biasing force of the trigger spring 3*c* (FIG. 11). At this time, the sear support portion 3*b* rotates the trigger sear 4 to cause the activation switch pressing portion 4*b* to break away from the activation switch 5*a*. This brings the control substrate 5 back into the initial state (same as the state in FIG. 1).

In the second embodiment, as illustrated in FIG. 15 and FIG. 16, the inner safety 81*b* is rotationally biased by the biasing force of the safety spring 82*b* in the initial state. When the bullet feed portion 15 moves down, for this reason, the inner safety 81*b* is abutted against the lower end face of the bullet feed portion 15 and interferes with the downward movement of the bullet feed portion 15. In this state, the following can be implemented even when impact is applied to the electric air gun due to, for example, dropping of the electric air gun and the striker 10 is moved backward against the biasing force of the striker spring 10*h*: the striker 10 does not press the valve 11. Thus a bullet W is not fired off unless the trigger 3 is pulled and the activation switch 5*a* is pressed.

When the trigger 3 is pulled and the activation switch 5*a* is pressed, the following takes place: the safety motor 8*b* is driven to rotate the safety rotating shaft 80*b* and the inner safety 81*b* is rotated against the biasing force of the safety spring 82*b* and enters the opening 15*d* as illustrated in FIG. 17 and FIG. 18. For this reason, the inner safety 81*b* is not abutted against the lower end of the bullet feed portion 15 and the bullet feed portion 15 moves down. Then the striker 10 presses the valve 11 and a bullet W is fired off.

In the electric air gun GN, as mentioned above, it is possible to obviate necessity for a large number of gears for transmitting the rotation of a motor. As a result, the structure of the gun is simplified and its manufacturing cost is reduced. The number of parts is reduced, which reduces the failure rate of the electric air gun GN and enhances its durability. Further, power consumption is reduced and thus running cost is reduced as well.

Further, the rotational driving force of a motor is transformed into the locomotion of a movable body (striker 10) by the firing action mechanism HM. Multiple actions, the movement of the valve 11 and the movement of the bullet feed portion 15, can be carried out by one action, or the backward movement of the movable body, at a time. As the result of the movement of the valve 11, compressed gas PG is jetted out toward the inner barrel. In conjunction therewith, the bullet feed portion 15 is moved and a bullet W in the chamber 15*a* is supplied to the bullet feed port 14*b* in the inner barrel 14. That is, firing action is made with a simple structure involving a smaller number of parts than in conventional electric air guns and this reduces failure rate and enhances durability.

The electric air gun GN does not use a solenoid but uses the main motor 7 and the rack and pinion mechanism RP. For this reason, the pressing force for moving the valve 11 backward in the above-mentioned electric air gun GN is stronger than that in electric air guns using a solenoid. This makes it possible to enhance the stability of the electric air gun GN and more inexpensively manufacture it.

In the electric air gun GN, further, the movable body (striker 10) of the firing action mechanism HM is moved by the main motor 7 and the rack and pinion mechanism RP and compressed gas PG is thereby jetted out. For this reason, switching between single firing and repetitive firing can be more easily carried out by adding a part for controlling the rotation of the main motor 7. In repetitive firing, it is easily achieved to limit the number of times of firing and arbitrarily change the limited number of times of firing. When the above retrofit is made, it is unnecessary to add any mechanistic change to each transmitting member. For this reason, the durability is not degraded and the failure rate is not increased.

In the electric air gun GN, energization of a motor is stopped by the backward movement of the movable body (striker 10) itself and it is possible to prevent the movable body (striker 10) from moving backward farther.

The electric air gun GN holds a large number of bullets in the hopper 16. For this reason, it is possible to easily cope with switching to repetitive firing. Each time a bullet is fired off, the hopper striker 10*f* collides with the hopper 16 and thus the bullets W in the hopper 16 are not jammed.

In the electric air gun GN, the rod 17 is moved backward together with the striker 10 and a bullet W is easily supplied to the chamber 15*a*.

The electric air gun GN is equipped with the safety motors 8*a*, 8*b*. This prevents a bullet W from being accidentally fired off by any other operation than pulling the trigger 3.

Obviously, numerous modifications and variations of the present invention are possible in light of the above teachings. It is therefore to be understood that within the scope of the appended claims, the invention may be practiced otherwise than as specifically described herein.

What is claimed is:

1. An electric air gun comprising:

a hollow inner barrel guiding a bullet fed into a bullet feed port toward a muzzle;

a bullet feed portion having a chamber for housing a bullet, installed so that the bullet feed portion can be freely reciprocated along the bullet feed port in the inner barrel, and positioned in a firing position for aligning the chamber to the bullet feed port and in a non-firing position for closing the bullet feed port by reciprocating movement;

a gas flow path guiding compressed gas supplied from a freely detachable compressed gas cylinder to the bullet feed port in the inner barrel through the chamber of the bullet feed portion positioned in the firing position;

a valve placed in the gas flow path and biased in a direction for closing this gas flow path;

a firing action mechanism having a movable body that can be freely reciprocated along the inner barrel and moving the bullet feed portion to the firing position using as power the movement of the movable body toward the bullet feed port and moving the valve to a non-biasing direction at the same time;

a power transmission unit having a motor and transforming the rotational driving force of the motor into the locomotion of the movable body and transmitting the locomotion through a rack and pinion mechanism; and a control unit energizing the motor using a freely detachable battery as an electric power source when detection is performed that a manually operated trigger has been pulled and moving the movable body toward the bullet feed port to actuate the firing action mechanism.

2. The electric air gun of claim 1, further comprising:

a stop switch installed in a place where the stop switch is brought into contact with the movable body moving, wherein:

the control unit stops energization of the motor when detection is performed that the movable body has been brought into contact with the stop switch.

3. The electric air gun of claim 1, further comprising:

an inner safety rotatably provided;

a safety spring rotationally biasing the inner safety to arrest the backward movement of the movable body; and a safety motor rotating the inner safety to the opposite side to the safety spring to permit the backward movement of the movable body.

4. The electric air gun of claim 2, further comprising:

an inner safety rotatably provided;

a safety spring rotationally biasing the inner safety to arrest the backward movement of the movable body; and a safety motor rotating the inner safety to the opposite side to the safety spring to permit the backward movement of the movable body.

5. The electric air gun of claim 1, further comprising:

an inner safety rotatably provided;

a safety spring rotationally biasing the inner safety to position the inner safety in a position where the inner safety interferes with the downward movement of the bullet feed portion; and a safety motor rotating the inner safety to position the inner safety in a position where the inner safety permits the downward movement of the bullet feed portion.

6. The electric air gun of claim 2, further comprising:

an inner safety rotatably provided;

a safety spring rotationally biasing the inner safety to position the inner safety in a position where the inner safety interferes with the downward movement of the bullet feed portion; and a safety motor rotating the inner safety to position the inner safety in a position where the inner safety permits the downward movement of the bullet feed portion.

7. The electric air gun of claim 1, further comprising:

a hopper with the top thereof open holding a large number of bullets; and a hopper striker installed on the movable body and caused to collide with the outer face of the hopper by the movement of the movable body.

8. The electric air gun of claim 1, further comprising:

a rod installed on the movable body, moved backward together with the movable body, and supplying a bullet in the hopper to the bullet feed portion.

* * * * *